United States Patent [19]

Harrison et al.

[11] 4,244,620

[45] Jan. 13, 1981

[54] WALL-PROXIMITY RECLINING CHAIR

[75] Inventors: Kenneth S. Harrison, Ridgefield; Robert J. Caldwell, Bloomfield, both of N.J.

[73] Assignee: Mohasco Corporation, Amsterdam, N.Y.

[21] Appl. No.: 888,833

[22] Filed: Mar. 22, 1978

[51] Int. Cl.[2] ..... A47C 1/035

[52] U.S. Cl. ..... 297/85; 297/89; 297/342

[58] Field of Search ..... 297/88, 89, 344, 342, 297/341, 340, 81, 78, 79, 83–86, 68

[56] References Cited

U.S. PATENT DOCUMENTS

| | | | |
|---|---|---|---|
| Re. 29,483 | 11/1977 | Ré | 297/88 |
| 3,781,060 | 12/1973 | Pentzien | 297/85 X |
| 3,941,417 | 3/1976 | Ré | 297/85 |
| 4,077,663 | 3/1978 | Cycowicz et al. | 297/83 |
| 4,108,491 | 8/1978 | Rogers, Jr. | 297/86 |

*Primary Examiner*—William E. Lyddane
*Attorney, Agent, or Firm*—Kirschstein, Kirschstein, Ottinger & Cobrin

[57] ABSTRACT

A wall-proximity reclining chair has body support members pivotally mounted by means of front and rear carrier links directly to a fixed base. The movable armrest assembly does not supply any load from the body support members. Each rear carrier link is pivotally suspended from an elevated rear point of the fixed base above a lower rear arm crossrail, thereby providing clearance for the lower rear arm crossrail to pass under it and also allowing the front and rear carrier links to be widely spread apart in a fore-aft direction, thus providing exceptional stability and smoothness of operation.

24 Claims, 10 Drawing Figures

WALL-PROXIMITY RECLINING CHAIR

FIELD OF THE INVENTION

This invention relates to a three-way or lounger type reclining chair which can be placed in close proximity to a wall when in its closed, upright sitting position, but will not contact that wall when placed in any of its reclining positions. The chair comprises a fixed base to which are mounted through carrier links, body-support members, namely, a seat portion and a separately articulated backrest. To the same aforementioned carrier links, is mounted an armrest portion, which, when pushed by the chair occupant, moves in a substantially linear direction away from the wall and causes, through interconnecting linkage, the seat and backrest to move relatively in the same direction, to the first reclining, or T.V. position. A projectable legrest is connected to the seat and is extended by linkage connected to the stationary base, to a leg supporting position when the chair is moved to the T.V. position. Further pushing on the armrest by the chair occupant causes the backrest to recline, which in turn causes the seat to move upwardly and forwardly, establishing thereby, a multiplicity of balanced reclining positions, from T.V. to fully reclined position. The body support members continue to move away from the wall during this further reclining action. To return the chain to T.V. position, the occupant sits up, creating a weight shift, causing the seat to move down and backward, and the back to move toward its upright position. To return the chair to closed upright sitting position the occupant merely applies downward pressure with the legs on the legrest.

BACKGROUND OF THE INVENTION

At the present time, the field of reclining chairs which are operable when placed in close proximity to a wall, has developed to the extent where two distinctly different systems are now in use for obtaining the necessary approximately linear movement of the arm frame away from the wall in order that the top of the backrest will not strike the wall in its fully reclined position. In non-handle operated recliners, relative motion of the arm frame versus the seat and/or backrest provides the motivating leverage for placing the chair in any of its various reclined positions. In wall proximity recliners, the above relative motion must be added to the motion required to move the body support members away from the wall to obtain the necessary clearance. The earlier of the two wall proximity systems e.g. see U.S. Pat. No. 4,077,663 mounts the arm frame on a roller and track combination, one part of which is attached to a fixed base, to provide the means for obtaining the linear motion necessary to carry the arm frame and body support members away from the wall. These roller and track systems in combination with the typical recliner linkage which is necessary for the reclining mode of the chair, are costly, require exacting alignment of the tracks on either side of the chair for smooth operation, require adjustment for synchronization of chair operation, and are subject to breakage of the rollers in use.

The latter of the two wall proximity systems e.g. see U.S. Pat. No. 3,941,417 utilize an all linkage mechanism for obtaining all motions of the recliner and thus eliminate all drawbacks of the roller and track type. The earlier of these all linkage systems merely substituted a straight line linkage for the roller and track, but had the disadvantage of lateral and rotational instability of the chair because the body support or weight bearing members are supported by the straight line linkage which in turn is pivotally mounted to the fixed base.

SUMMARY OF THE INVENTION

An object of the present invention is to avoid the difficulties encountered with previous constructions described above.

Another object of this invention is to provide a lounger of the character described comprising an all-linkage three-way or lounger type wall proximity reclining chair system in which the body-support members are pivotally mounted, by carrier links, directly to a fixed base and in which the use of an elevated pivot point on the fixed base, for the rear carrier, contribute to a high degree of stability. The direct pivoting to the base contributes to stability by minimizing the number of pivotal connections between the fixed base and the body support members; the use of an elevated pivot contributes to stability because it allows the use of short carrier links whose deflection will be minimal.

A further object of this invention is to provide in a chair of the character described, relatively short carriers and hence a vertically compact linkage which results in a comfortable chair with a low seat, which is a highly desireable characteristic.

Still another object of this invention is to provide in a chair of the character described, an elevated rear carrier to provide clearance for a lower rear crossrail to pass under it, which allows for a large range of styling flexibility, that is, short petite frames to large frames.

Yet another object of this invention is to provide in a chair of the character described an elevated rear carrier which allows the rear cross-rail of the arm frame of the chair to move under the linkage, which allows the carriers to be spread out in a fore-aft direction, thus providing exceptionally good stability and smoothness of operation.

A further object of this invention is to provide in a chair of the character described, highly improved positive sequencing means to prevent the occupant of the chair from assuming a fully reclined position before the legrest has been projected in the T.V. position, and to prevent closing of the legrest when the chair is in any of the positions of the chair from fully reclined to T.V. position.

A still further object of this invention is to provide in a chair of the character described a legrest system mounted to the linkage to be activated between a vertically stored position at the front of the chair when the chair is in closed upright or sitting position, to a projected position in a plane substantially parallel to the floor when the chair is in the T.V. position and in any of the reclining positions from T.V. to fully reclined position.

Yet a further object of this invention is to provide in a chair of the character described highly improved shield means to cover the portion of the linkage which would be exposed behind the arm-frame when the chair is reclined.

A still further object of this invention is to provide hardware for a chair of the character described that can be purchased by upholsterers and readily incorporated into chair bodies which may then be upholstered.

Yet another object of this invention is to provide a chair and hardware therefor, of the character described which shall be rugged and durable, relatively inexpensive to manufacture, easy to be assembled into a completed chair and which shall yet be practical and efficient to a high degree.

Other objects of this invention will in part be obvious and in part hereinafter pointed out.

The invention accordingly consists in the features of construction, combinations of elements, and arrangement of parts which will be exemplified in the construction hereinafter described and of which the scope of invention will be indicated in the following claims.

IN THE DRAWINGS

DETAILED DESCRIPTION OF THE PREFERRED EMBODIMENTS

Figure 1:
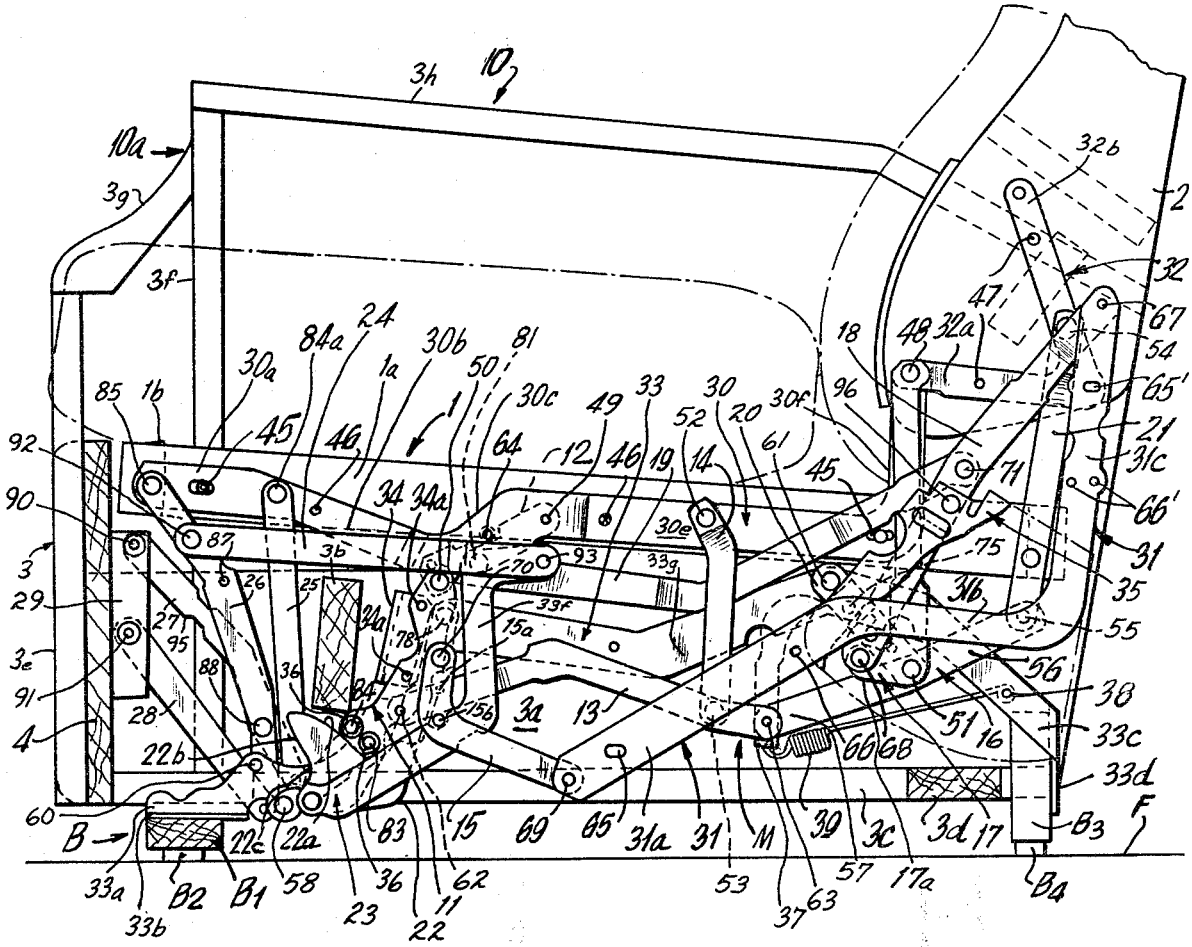
FIG. 1 is an elevational view of a chair in closed position embodying the invention looking to the side of the chair which is at the right side of a person standing in front of the chair facing the chair, and with the right chair arm removed to expose the hardware at the said right side of the chair.

Referring now in detail to the drawing, 10 designates a chair embodying the invention. Said chair comprises a chair body 10*a*. The chair body comprises right and left, similar, symmetrically disposed, chair armrest assemblies or frames 3. Said chair arm frames comprise longitudinally extending boards or walls 3*a* disposed in vertical planes and interconnected by a front arm cross-rail 3*b*. Only the chair arm disposed to left of a person standing in front of the chair facing the chair, is shown in the drawing. Since the chair arms are similar and symmetrically disposed, only the one shown in the drawing will be described.

At the lower end of wall 3*a* is a horizontal, longitudinal runner 3*c*. The runners 3*c* of both chair arm frames are interconnected by a rear arm cross-rail 3*d*. At the front of the chair arm 3 is a vertical post 3*e* contacting the front end of wall 3*a*. A vertical support 3*f* contacts the outside of wall 3*a* and is located rearwardly of the post 3*e*. The post 3*e* is connected to support 3*f* by an inclined member 3*g*. At the top of chair arm frame 3 is an arm rest 3*h*. The chair arms may be conventional.

Between the chair arms 3 there is a rectangular wood seat frame 1 comprising longitudinal seat rails 1*a* interconnected by transverse seat end rails 1*b*. Attached to the outside of each rail 1*a* is a seat mounting member or link 30. Said seat link 30 comprises a forward end part 30*a* parallel to the seat frame. Extending from the rear end of part 30*a* is a downwardly and rearwardly part 30*b* which projects below the seat frame. Extending from the rear end of part 30*b* is an upwardly and rearwardly inclined part 30*c*. Extending from the rear end of part 30*c* is a part 30*e* parallel to the seat frame. Extending upwardly from the rear end of part 30*e* is a part or arm 30*f* projecting above the seat frame. Pivoted to the upper end of arm 30*f* as at 48 is a V-shaped back mounting member or link 32 to which a chair back 2 is fixed. The back link 32 has one arm 32*a*, the outer end of which is pivoted to the pivot 48. Arm 32*a* is located transversely of the chair back 2. Extending from arm 32*a* is another arm 32*b* also fixed to the chair back 2. Thus the chair back 2 can swing relative to the seat frame.

Attached to board 3*a* at each side of the chair is an armrest mounting member or link 31. As shown in FIG. 1, armrest link 31 comprises a forward part 31*a* which slants downwardly and forwardly to the level of the rear cross-rail 3*d* and runner 3*c*, at about midway between the front and rear ends of the chair arm 3. The attachment is at lower slot 65 and hole 66 (see FIG. 1). Extending rearwardly from the rear upper end of part 31*a*, said arm mounting link has a substantially horizontal portion 31*b*. As best shown in FIG. 1, extending up from the rear end of portion 31*b* is a substantially vertical arm 31*c* having a pivot 67 which is located at the rear end of the chair arm above the height of pivot 48. Below its upper end, arm 31*c* is attached by any suitable means passing through holes 66' in arm 31*c* and through a slot 65' in said arm and above holes 66 in said arm. The upper end of arm 31*c* is attached to wood blocks (not shown) fixed to the rear upper end of the chair arm. Horizontal portion 31*b* has not been shown in FIGS. 2 and 3 to simplify these figures.

The chair also comprises a base B which rests on the floor F in somewhat spaced relation to a non-illustrated room wall disposed in back of the chair near the non-illustrated upper end of the chair back 2.

In the upright position of FIG. 1, the chair body is substantially over the base but projects forwardly therefrom, somewhat.

The base B comprises a front transverse cross-rail $B^1$ disposed in a horizontal plane and provided with floor contact pads $B^2$, and a rear cross-rail $B^3$ in a vertical plane provided with floor contact pads $B^4$. The ends of the front cross-rail $B^1$ are fixed to the rear cross-rail $B^3$ by a pair of similar, symmetrical longitudinal base mounting members or links 33.

At each side of the chair, a base link 33, an arm mounting member 31, a seat link 30, a back link 32, and the leg rest 4 (to be described hereinafter) are interconnected by linkage mechanism M to be described hereinafter, to produce hardware which will allow the seat and back of the chair to move from the upright or closed position of FIG. 1 to the T.V. position of FIG. 2, and from the T.V. position to the fully reclined position of FIG. 3, and from the fully reclined position of FIG. 3, to the T.V. position of FIG. 2, and from said T.V. position back to the upright position of FIG. 1. Further, as the chair moves from the upright position to the T.V. position, the leg rest is projected, and the chair body moves forward as the seat and back recline to T.V. position, so that the rear upper end of the chair back will not contact the wall in back of the chair, and as the chair is moved from T.V. to fully reclined position, the chair body moves further forwardly and the chair back does not touch the wall even though the back tilts further backwards, as shall be explained hereinafter.

The hardware at opposite sides of the chair are similar and symmetrically disposed so that the hardware at only one side of the chair will be described. The hardware described is located at the right of a person standing in front of the chair and facing the chair.

The base link 33 at its front end 33*a* has a horizontal flange 33*b* resting on and attached to front cross-rail $B^1$. The vertical rear end 33*c* has a downwardly extending vertical transverse flange 33*d* contacting and attached to the rear side of the cross-rail $B^3$. Between the flanges 33*b*, 33*d*, the base link is in a vertical plane. However, the base link may be made of two pieces attached together about midway between its ends, to facilitate manufacture.

The front end portion 33*a* of base link 33 is provided with a stop 60 near its upper edge. Said front end portion 33*a* extends rearwardly of the flange 33*b*. Extending from the rear end of portion 33*a* is an upwardly and rearwardly extending portion 33*e* provided with a stop pin 79 (FIG. 2) for the purpose hereinafter appearing. Extending rearwardly from the rear end of portion 33*e*, is a substantially horizontally extending portion 33*f* (FIG. 3) from the rear end of which another upwardly inclined portion 33*g* (FIG. 2) extends to a greater height. Extending rearwardly from the upper rear end of portion 33*g* is a downwardly and rearwardly slanting portion 33*h* (FIG. 3) from which the rear end portion 33*c* slants downwardly and rearwardly to the offset flange 33*d*.

The seat link 30 is rigidly attached to the seat at slots 45 and holes 46. Back link 32 is fixed to the chair back at holes 47.

Pivoted to the seat link 30, as by pivot 49 (FIG. 3) located at the forward end of portion 30*e* of the seat link, is a front secondary carrier link 12. The lower end of said secondary carrier link 12 is pivoted as at 50 to one end of a front primary carrier link 11. The lower end of said front primary carrier link 11 is pivoted as at 58 to the base link 33 close to the offset flange 33*b*. The front carrier links 11, 12 constitute the front seat carrier means of the body support-to-base linkage means described below.

Rear secondary carrier or seat pivot link 17 (FIG. 2) is pivoted at its upper end to pivot 48 at the upper end of arm 30*f* of the seat link 30. The lower end of said link 17 is pivoted as at 51 to the lower end of a rear primary seat carrier link 20 (FIG. 2), the upper end of which is pivoted, as at 61 to the base link 33 at its most elevated point, at the junction of portions 33*g*, 33*h* of said base link. Link 17 has an angular arm 17*a* pivoted as at 68 to the lower end of a rear arm carrier link 18. The front primary carriers 11 on both sides of the chair are interconnected by angle brackets 34 (FIG. 2) attached to said primary carriers 11 by rivets 34*a* to which the opposite ends of a transverse cross-rail (not shown) are attached.

The upper end of rear arm carrier link 18 is pivoted to the upper end of arm 31*c* of the arm mounting member 31, as at 67. A seat control means or link 14 is pivotally connected to the seat link 30, as at 52, located about midpoint between the ends of portion 30*e* of the seat link. Said control link 14 is pivoted at its lower end, as at 53, to a drag means or link 13. Said drag link 13 is pivoted at its forward end, as at 62, to an intermediate portion of the front primary carrier link 11. The rear end of drag link 13 is pivoted as at 63 to one end of a front arm 57 of a crank link 16. The rear end of rear carrier arm 56 of the crank link 16 is pivoted as at 55 to the lower end of a back carrier link 21. The upper end of back control means or link 21 is pivoted, as at 54 to arm 32*b* of the back link 32. The rear carrier links 17, 20 constitute the rear seat carrier means of the body support-to-base linkage means. The back carrier links 21 and 56 constitute the backrest carrier means of the body support-to-base linkage means. The front seat carrier means, the rear seat carrier means and the backrest carrier means are together operative for kinematically connecting the seat-mounting members 30 and back-mounting members 32 directly to the base.

A front arm carrier link 15 is pivoted at its lower end, as at 69, to the front lower end of the arm mounting link 31. The front arm carrier link 15 has an upper, upwardly and rearwardly inclined arm 15*a* pivoted as at 70 to the front primary carrier link 11. At the junction of arm 15*a* with link 15 is a stop pin 15*b*. Pivot 70 is spaced downwardly from pivot pin 50.

OPERATION OF THE CHAIR

The body support members, i.e., seat 1 and backrest 2 are carried from closed upright position of the chair to its T.V. position by primary front seat carrier 11 and rear seat carrier 20. The primary carrier 11 is attached to a stationary base link 33 at pivot 58, and rotates in a counterclockwise direction from closed to T.V. position between the stop-pins 59 and 60. The rear carrier 20 is attached to base link 33 at elevated pivot 61 and rotates in a clockwise direction from closed to T.V. positions. The primary carrier 11 pulls the rear carrier 20 forward during this part of the cycle, by means of drag link 13, connected to primary carrier 11 at pivot 62, and arm 57 of crank 16 through the pivotal connection 63, said crank 16 being pivotally connected to rear carrier 20 at 51. The front secondary carrier 12, previously described, connects the seat link 30 to the primary carrier 11, and by contact with stop-pin 64 remains fixed relative to the seal link 30 from closed to T.V. positions.

The upward, forward motion of the primary carrier 11 at 50, and the downward, forward motion of the rear carrier 20 at 51, causes a translation of the seat from a relatively horizontal plane when in closed position, to the more angular position in T.V. position, but during this translation, the center of gravity of the occupant travels in an approximately horizontal plane, thus minimizing the effort required to move the chair from closed to T.V. position. Also, during this translation, the seat and backrest have been moved a distance away from the wall, thus establishing clearance for reclining.

Also, during movement from closed to T.V. positions, the back link 32 closely maintains its angular relationship with the seat by virtue of the clockwise rotation of the crank 16, which causes the pivot connection 55 to travel in a path which accomplishes the above. Also, during movement from closed to T.V. positions, pivot 63 remains below a line connecting pivots 62 and 51, which condition assists in preventing free rotation of crank 16, thus helping to prevent articulation of the backrest relative to the seat.

When the primary carrier 11 contacts stop-pin 60 the T.V. position of the chair is defined, and the occupant body weight acting downward on pivot 50 which has reached the downward portion of its arc of travel will tend to keep the primary carrier in this stationary position. During the travel from closed to T.V. positions, the legrest 4 to be described later, has been projected to an approximately horizontal leg-supporting position from its vertical, stored position at the front of the closed, upright chair.

The chair is operated from closed upright position to the T.V. position by the occupant pushing on the arm frame 3, thus generating a pressure differential between the arm frame and the backrest/seat combination. Fixed rigidly to the arm frame 3, as at slots 65' and holes 66', is an arm mounting link 31 to which is pivotally attached at its upper rear end at 67, a rear arm carrier 18, and to its lower front end at 69 is pivotally attached a front arm carrier 15. Front arm carrier means or link 15 is pivotally connected to the primary carrier 11 at pivot or bypass-connection point 70. Rear arm carrier means or link 18 is pivotally connected at its lower end at pivot or bypass-connection point 68 to arm 17*a* of rear seat pivot link 17. Front and rear arm carriers 15, 18 together comprise drive linkage means which operatively connects each armrest-mounting member 31 to the body support-to-base linkage means (11, 12, 17, 20, 21, 56) at the bypass connection points 68, 70. Smoothest chair operation is attained if the arm frame moves in a relatively horizontal plane as it drives the body-support members 1, 2 from closed to T.V. position. Such horizontally planar motion is also desireable to prevent the undersurface of the arm frame from scuffing against the carpeting or floor as it moves. This is accomplished at the rear arm frame pivot 67 by the zero vertical vector sum of the upward arcuate path of pivot 67 as it rotates about pivot 68, and the downward arcuate path of pivot 68 as it rotates about pivot 51 and translates about pivot 61. At the forward arm frame pivot 69, the zero vertical vector sum is obtained by combining the downward-upward arcuate path of pivot 69 as it rotates about pivot 70 on the primary carrier 11, with the upward-downward arcuate path of pivot 70 as it rotates about stationary pivot 58. Pivotally connected to the approximate midpoint of the rear arm carrier 18 at 71 is a seat driver 19, the opposite end of which is pivotally connected to the secondary carrier 12 at 72. The seat driver 19 serves to transmit the thrust from the rear arm carrier 18 to the forward end of the seat link 30 through the secondary carrier 12 which as previously noted remains in a fixed position relative to the seat link 30 from the closed to T.V. positions. The thrust causes rotation of primary carrier 11 through the pivot connection 50, from its closed position against stop-pin 59 on base link 33 to its T.V. position against stop-pin 60 on base link 33.

To assume any of the multiplicity of balanced reclining positions from T.V. to fully reclined positions, the occupant presses against the backrest by pushing lightly on the armrest. The back link 32 is now capable of rotating clockwise relative to the seat link 30 about pivot 48. Pivot 63 has arrived at an almost co-linear position between pivots 62 and 51 and is now free to move upward through this line as a clockwise rotation is imparted to the crank 16 through the back control 21 by downward thrust from the rotating back link 32. The upward motion of pivot 63 causes rotation of the drag link 13 about pivot 62 on the primary carrier 11 which remains stationary from T.V. to fully reclined position. This upward-forward rotation of the drag link 13 serves to drive the seat link 30 in the same direction by means of the seat control link 14. This upward forward motion of the seat link 30 at pivot 48 causes upward forward rotation of the secondary carrier 12 about pivot 50 on the primary carrier 11, which is now stationary. The resulting motion of the front of seat link 30 is sharply upward and slightly forward. At the same time, the upward forward motion of pivot 63 pulls the rear carrier 20 forward and upward by means of arm 57 of crank 16, which lifts the rear seat pivot member 17 and results in an upward, forward motion of the rear of the seat link.

The upward motion of the seat 1 as the backrest 2 is rotating backward and downward, establishes an approximate balance between the two body support members such that they will maintain any reclined position desired, between T.V. and fully reclined position of the chair. The concomitant forward motion of the seat and backrest provides additional wall clearance.

Figures 2, 4:
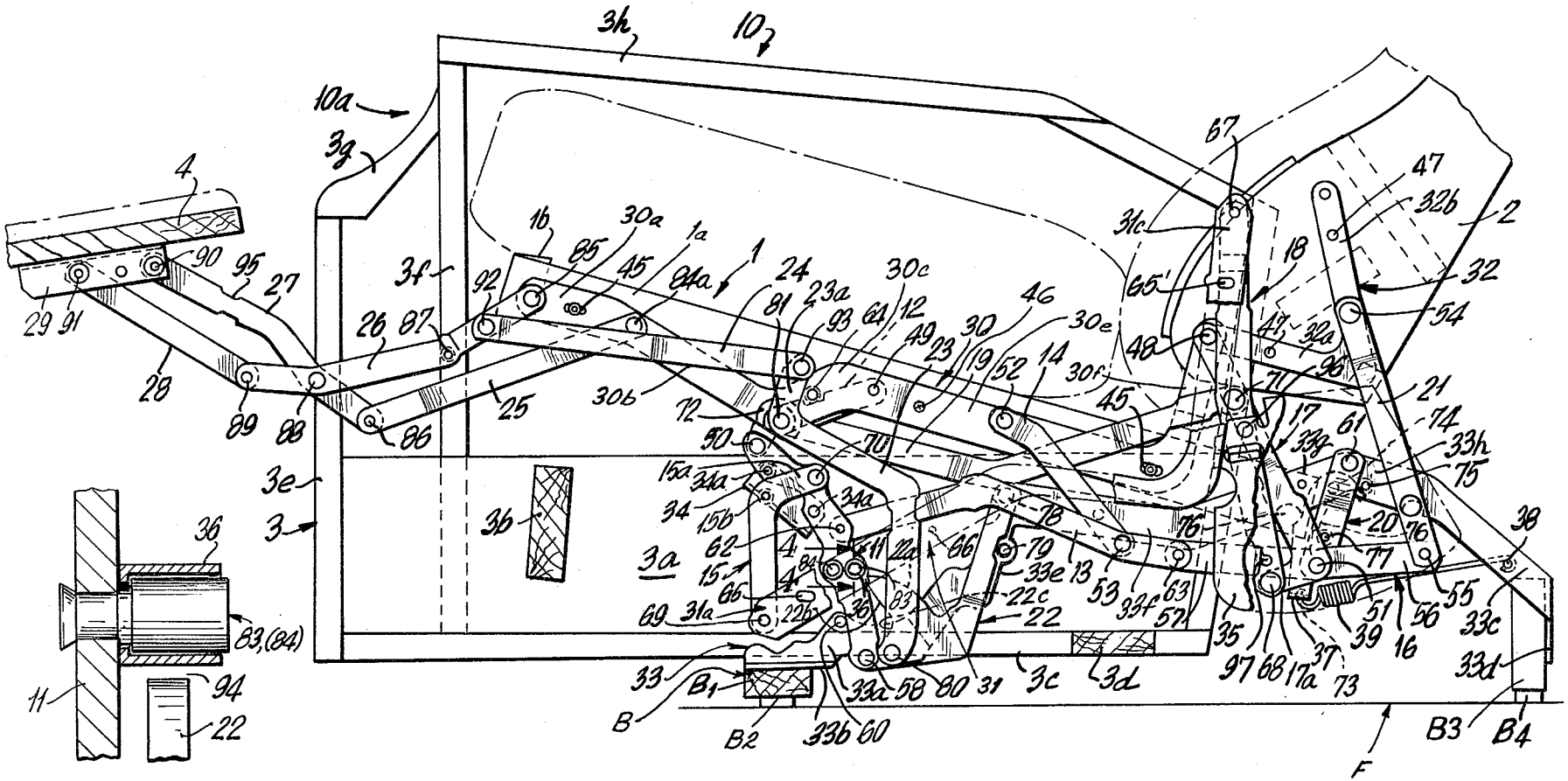
FIG. 2 is a view similar to FIG. 1 but showing the chair in T.V. position.
FIG. 4 is a cross-sectional view taken on line 4—4 of FIG. 2.
Figure 3:
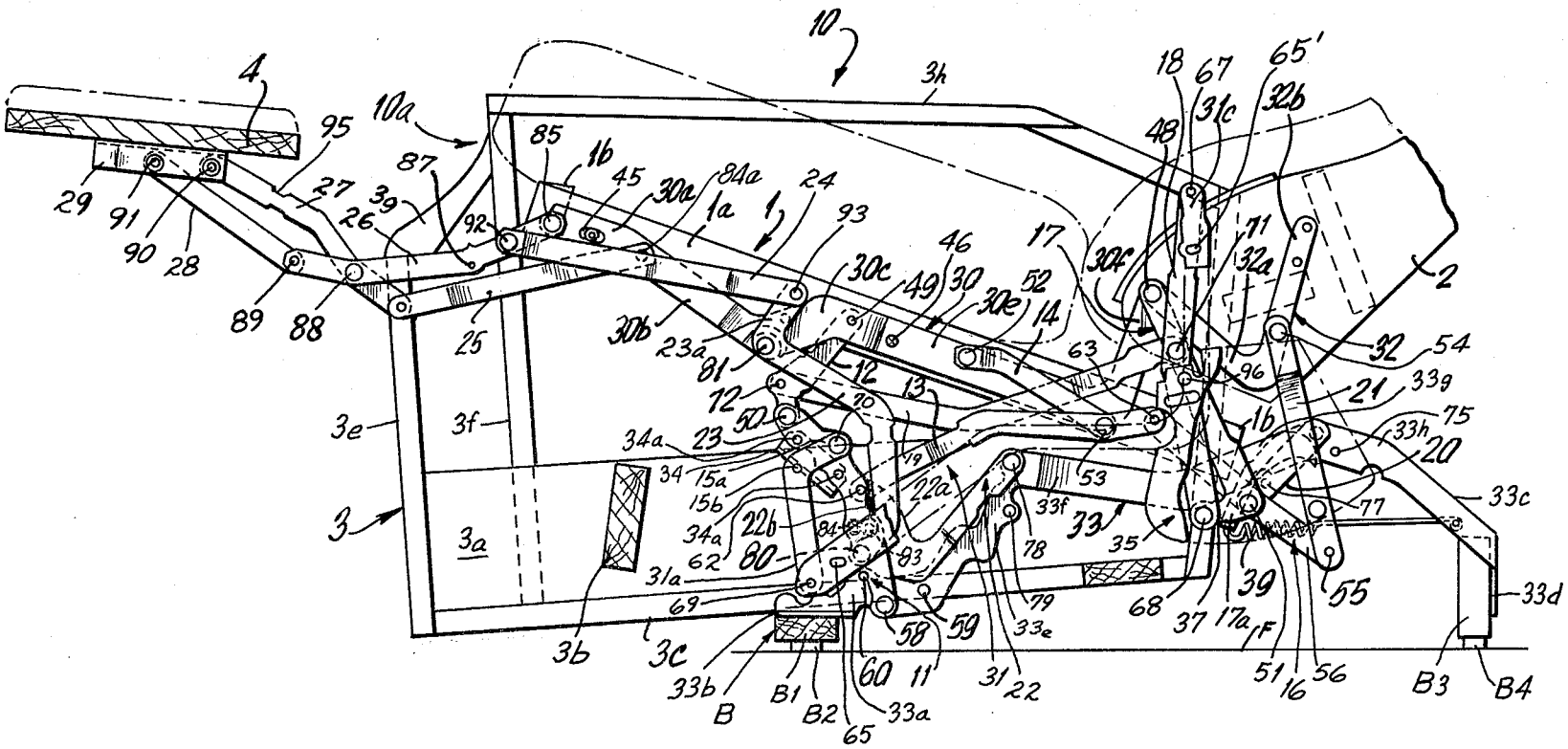
FIG. 3 is a view similar to FIG. 2 but showing the chair in fully reclined position.
Figure 5:
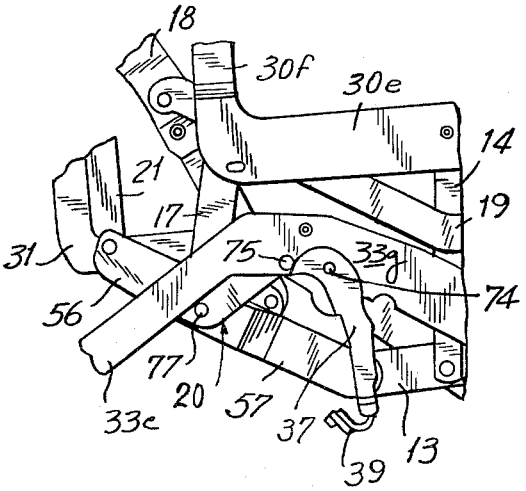
FIG. 5 is a partial elevational detail view showing the rear primary seat carrier link and surrounding links from the rear in the closed position of FIG. 1.
Figure 6:
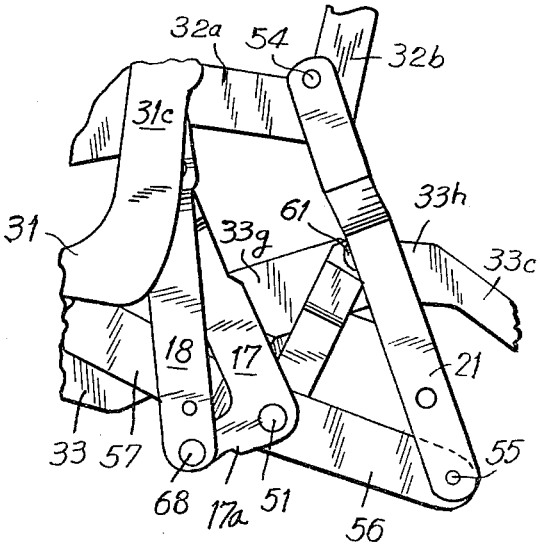
FIG. 6 is a partial elevational detail view showing the rear primary seat carrier link and surrounding links from the front in the fully reclined position of FIG. 3.
Figure 7:
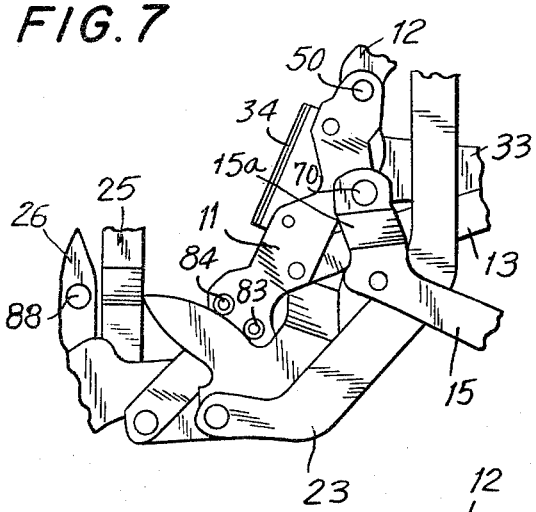
FIG. 7 is a partial elevational detail view showing the front primary seat carrier link and surrounding links from the front in the closed position of FIG. 1.
Figure 8:
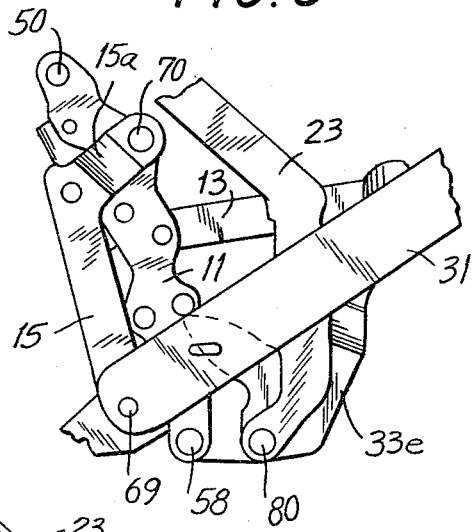
FIG. 8 is a partial elevational detail view showing the front primary seat carrier link and surrounding links from the front just prior to the TV position of FIG. 2.
Figure 9:
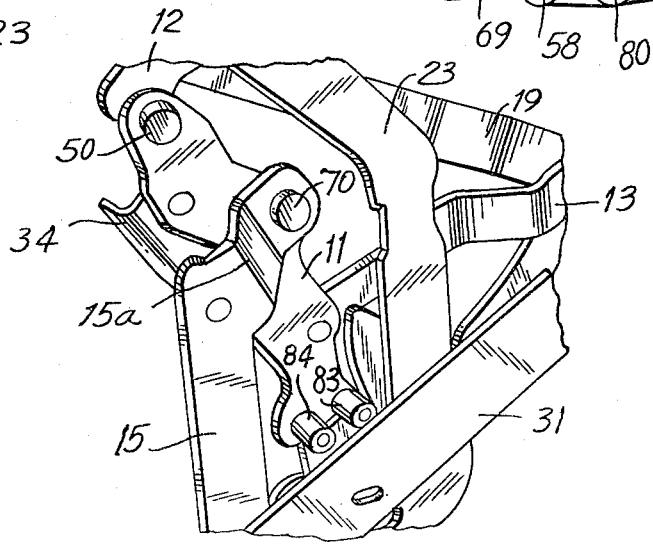
FIG. 9 is a partial enlarged perspective detail view showing the front primary carrier link, the sequence link and surrounding links from the front and above in the fully reclined position of FIG. 3.
Figure 10:
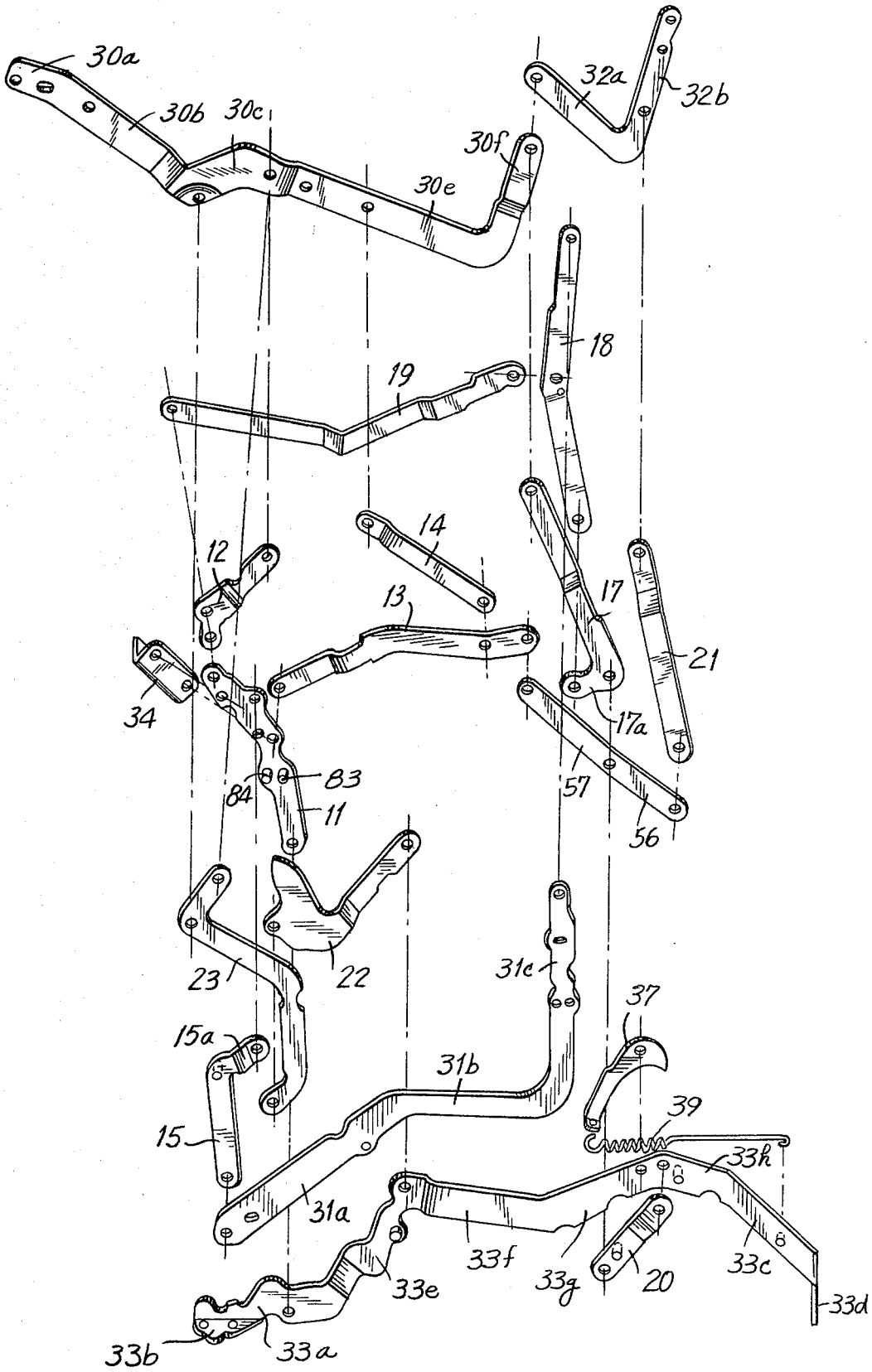
FIG. 10 is an enlarged exploded view showing the recliner mechanism and sequencing system with the legrest mechanism omitted.

To assist in obtaining optimum balance, an extension spring 39 is attached to the base link or member 33 at 38, while at its opposite end, the hook is engaged with hole 73 of balance control member or lever 37, which is pivotally connected to base link 33 at 74 (see FIG. 2). A stop-pin 75 on the base link 33 engages a surface of the balance control member 37 to maintain its position when inactive. A pin 77 on rear carrier link 20 engages with an edge of seat 76 of balance control member 37, when approximately in the T.V. position. From the T.V. position to full recline position, the pin 77 drives the balance control member 37 in the same direction. The resulting rotation of the balance control member 37 stretches the extension spring or biasing means 39 generating a resisting load against the rear carrier link 20 through the pin 77, thereby improving the balance between body support members 1,2 from T.V. to recline positions.

SEQUENCING SYSTEM

Positive sequencing is provided to prevent the occupant from assuming a fully reclined position before the legrest has been projected in the T.V. position, and to prevent closing the legrest when the chair is in any of the positions from T.V. to fully reclined.

Pivotally attached to base link or member 33 at 78, is a sequence link 22 which is pivotally attached at 80 to a sequence control link 23 which is pivotally attached to seat link 30 at 81 and which is pivotally connected to legrest driver 24 at 93. Sequence link 22 has two arcuate surfaces 22*a* and 22*b*. The center of the upper arc 22*a* coincides approximately with the center of pivot 58 of the primary carrier 11 from the closed to T.V. positions of the chair. The center of the lower arc 22*b* coincides with the center of pivot 78 of the sequence link 22. A pair of rollers 36 is captively mounted at 83 and 84 on primary carrier 11 for blocking contact with the arcuate surfaces 22*a* and 22*b* of sequence link 22. The captive mounting of the rollers is best exemplified in the cross sectional view of FIG. 4. It will be understood that in normal operation of the chair, there is no contact between the rollers 36 and the arcuate surfaces 22*a* and 22*b*, there being a clearance space 94 as best indicated in FIG. 4. From closed to T.V. position of the chair, pivot 81 on seat link 30 travels in an approximate counterclockwise arc about pivot 80, thus causing sequence control link 23 to rotate about pivot 80 which remains stationary during this movement. Sequence link 22 will therefore maintain its fixed position against stop pin 79 on base link 33, and arcuate surface 22*a* will maintain concentricity about pivot 58 about which the primary carrier 11 is rotating. The rollers 36 will therefore travel in a clearing path above arcuate surface 22*a*. From T.V. to recline, as aforementioned, the primary carrier 11 remains in fixed position against stop-pin 60, and elevation of the front of seat link 30 lifts the sequence control link 23, thereby lifting pivot 80 upwardly and causing clockwise rotation of sequence link 22 about pivot 78. The arcuate surface 22*b* will pass by the right side of the roller at 83. The fully reclined position of the chair is reached when arcuate surface 22*c* (FIG. 2) contacts the roller at 83. Should the occupant attempt to recline the chair before the T.V. position is reached, the front of seat link 30 will rise, lifting sequence control link 23 causing premature rotation of sequence link 22 and causing upper surface 22*a* to contact the blocking rollers 36 and preventing further reclining motion. Should the occupant attempt to close the legrest 4 when going to the fully reclined positions of the chair, the resulting backward thrust through legrest driver 24 will cause primary carrier 11 to rotate clockwise, thus causing the roller 36 at 83 to contact lower surface 22*b* of the sequence link 22, therefore blocking further retraction of the legrest.

It is thus seen that effective blocking action is provided to prevent the chair from being operated out of sequence by the sequence control means or links 22, 23.

LEG REST SYSTEM

The legrest 4 is supportively mounted to the linkage to be activated between a vertically stored position at the front of the chair when the chair is in the closed upright position to a projected position in a plane relatively parallel to the floor when the chair is in the T.V. position and in any of the reclining positions from T.V. to fully reclined.

A legrest driver 24 is pivotally attached at one end to arm 23*a* of sequence control link 23 at 93 and its opposite end is pivotally attached at 92 to legrest actuator 26. The legrest actuator 26 is pivotally attached to seat link 30 at 85, is pivotally connected with legrest guide 27 at 88, and is pivotally connected at its distal end with legrest support 28 at 89. Pivotally attached to legrest support 28 at 91 and to legrest guide 27 at 90, is a legrest bracket 29 which is rigidly fixed to legrest 4. A notched surface 95 of legrest guide 27 engages a stop-pin 87 on legrest actuator 26 when the chair is in closed upright position to determine the stored position of the legrest. A legrest idler 25 is pivotally attached to seat link 30 at 84*a* and to legrest guide 27 at 86. Links 24–28 constitute the legrest drive linkage means.

Motivation of the legrest is accomplished by the counterclockwise rotation of arm 23*a* of sequence control link 23 relative to seat link 30 as the sequence control link 23 rotates about 80 from closed to T.V. position. Forward thrust from pivot 93 is transferred by legrest driver 24 to pivot 92 which causes clockwise rotation of legrest actuator 26, and which, through the interconnections causes projection and elevation of legrest 4 to its comfortable, leg-supporting position in T.V. It is desired to maintain the angular position of the legrest relative to the seat from T.V. to fully reclined positions in order not to elevate the legs to an uncomfortably high position. This is accomplished by the virtual elimination of further rotation of sequence control link 23 because the upward forward motion of pivot 80 is matched by the upward forward motion of pivot 81. Thus arm 23*a* does not rotate relative to the seat from T.V. to recline, thereby maintaining the legrest position.

SHIELD

To cover the portion of the linkage which would be exposed behind the arm frame when the chair is opened, a shield 35 of plastic or other material, shown in partial and phantom view in the drawings, is rigidly attached to rear arm link 18 at 96 and 97. As that portion of the rear arm link moves forward slower than the arm frame, the shield will be projected and will assume a protective position and provide a more attractive appearance to the rear of the chair when it is open. When the chair is in closed upright position, the rear of the arm frame conceals the stored shield.

CHAIR RETURN OPERATION

To return the chair to T.V. position from any of the reclining positions, the occupant sits up slightly, thus causing an imbalance between the backrest and the seat, causing the seat to move rearward and downward and causing the unloaded backrest to rotate counterclockwise toward its upright position. To return the chair to closed upright position from T.V., the occupant presses down on the legrest. This motion generates a rearward thrust on the legrest driver 24 causing clockwise rotation of sequence control 23 and of primary carrier 11. During this motion, the arm frame 3, seat 1, and backrest 2, are returned rearward so that, when closed, the chair has assumed its position in close proximity to the wall.

It will thus be seen that there is provided a device in which the several objects of this invention are achieved and which is well adapted to meet the conditions of practical use.

As various possible embodiments might be made of the above invention, and as various changes might be made in the embodiment above set forth, it is to be understood that all matter herein set forth or shown in the accompanying drawings is to be interpreted as illustrative.

We claim:

1. In a wall-proximity reclining chair of the type having (A) a base for supporting the chair on a floor;

(B) body-supporting means including a seat located generally above the base, and a backrest located generally rearwardly of the seat, said body-supporting means having a pair of seat-mounting members each located at an opposite side of the seat, and a pair of backrest-mounting members each located at an opposite side of the backrest; and (C) a movable armrest assembly mounted for longitudinal horizontal reciprocating movement relative to the base, including a pair of armrests, each located at an opposite side of the seat, and a pair of interconnected armrest-mounting members each mounted on a respective armrest for moving the armrest assembly forwardly and rearwardly as a unit relative to the base in response to manual urging on the armrest assembly by a seated user;

the improvement comprising:

(a) body support-to-base linkage means kinematically connecting the seat-mounting members and backrest-mounting members directy to the base along a direct force-transmitting path which bypasses the armrest-mounting members such that any load having a force component which acts generally downwardly on the body-supporting means is directly transmitted along the force-transmitting path only to the base, and not to the armrest-mounting members; and (b) drive linkage means for moving the body-supporting means between an end-limiting upright position in which the seat and backrest are spaced a predetermined distance away from a room wall behind the chair, and an end-limiting fully reclined position in which the seat and backrest are forwardly spaced at a greater distance from the room wall such that physical contact of the body-supporting means with the room wall is avoided in said positions, said drive linkage means operatively connecting each armrest-mounting member to said body-support-to-base linkage means at bypass connection points which transmit no downwardly-acting force component from the seat-mounting members and backrest-mounting members to the armrest-mounting members such that the latter are isolated from any transmission of downwardly-acting forces from the body-supporting means in said positions of the latter, whereby the seat and backrest are moved between said positions without excessive wobble or instability.

2. The improvement as defined in claim 1, wherein said base includes an elongated base link at each side of the chair, each base link having a front base portion, a rear base portion, and a longitudinally-extending elevated base portion which extends from the rear base portion towards the front base portion over a substantial part of the length of the base link, said elevated base portion being spaced at a predetermined distance above the floor and defining a longitudinally-extending clearance channel therewith underneath the chair; and further comprising a lower rear arm crossrail interconnecting the armrests at a lower rear region of the armrest assembly, said lower rear arm crossrail being mounted on the armrest assembly for moving together with the latter during said reciprocating movement, said lower rear arm crossrail being received in said clearance channel and being movable therealong without mechanical interference with any of said linkage means.

3. The improvement as defined in claim 1; and further comprising seat control means operatively connected between said seat-mounting members and said body support-to-base linkage means, and operative for moving the seat from its upright position in which the seat lies generally horizontally relative to the base, to its fully reclined position in which the seat is inclined relative to the base.

4. The improvement as defined in claim 1; and further comprising back control means operatively connected between said backrest-mounting members and said body support-to-base linkage means, and operative for moving the backrest from its upright position in which it defines a predetermined angle relative to the seat, to its fully reclined position in which it defines a greater angle relative to the seat.

5. The improvement as defined in claim 1; and further comprising a shield mounted on said body support-to-base linkage means at the rear of the chair for covering the area of said body support-to-base linkage means which would otherwise be exposed when the armrest assembly moves forward.

6. The improvement as defined in claim 1, wherein said drive linkage means is operative for moving the body-supporting means to an intermediate partially reclined TV position in which the seat and backrest are spaced a distance away from the room wall which is intermediate said predetermined distance and said greater distance; and wherein the chair also has a footrest assembly including a legrest, a legrest-mounting member, and legrest drive linkage means operatively connected to said body support-to-base linkage means and to the front portions of the seat-mounting members at each side of the chair, for successively extending the footrest from a vertically stored position at the front of the chair when the body-supporting means is in said upright position, to an intermediate projected position in which the legrest is located at a predetermined elevation above the floor when the body-supporting means is in said TV position, and thereupon to a fully reclined position in which the legrest is located at a relatively higher elevation when the body-supporting means is in said fully reclined position.

7. The improvement as defined in claim 6; and further comprising sequence control means for preventing movement of said body-supporting means to its fully reclined position before the legrest has assumed its intermediate projected position, and for preventing retraction of the legrest when said body-supporting means is moved between its TV and fully reclined positions.

8. The improvement as defined in claim 1, wherein said body support-to-base linkage means includes rear seat carrier means at each side of the chair each operatively supportively connecting a rear portion of the seat to the base, and front seat carrier means at each side of the chair each operatively supportively connecting the seat portion which is more forward than said rear seat portion.

9. The improvement as defined in claim 8; and further comprising drag link means operatively connected between said front seat carrier means and said rear seat carrier means, and operative for pulling said rear seat carrier means in forward direction when said front seat carrier means is pushed forwardly, and also for pulling said front seat carrier means in rearward direction when said rear seat carrier means is pushed rearwardly.

10. The improvement as defined in claim 8, wherein each front seat carrier means includes an elongated front primary seat carrier link and an elongated front secondary seat carrier link, said front primary carrier link having one end pivotally mounted on the base, and its opposite end pivotally connected to one end of the front secondary carrier link, said front secondary carrier link having its opposite end pivotally mounted on said forward seat portion.

11. The improvement as defined in claim 10, wherein each rear seat carrier means includes an elongated rear primary seat carrier link and a rear secondary seat carrier link, said rear primary carrier link having one end pivotally mounted on the base, and its opposite end pivotally connected to a portion of the rear secondary carrier link; and wherein another portion of the rear secondary carrier link is pivotally mounted on said rear seat portion.

12. The improvement as defined in claim 11, wherein said body support-to-base linkage means includes backrest carrier means at each side of the backrest each having a back carrier link operatively connected to said opposite end of said rear secondary seat carrier link.

13. The improvement as defined in claim 11, wherein said drive linkage means is operative for moving the body-supporting means to an intermediate partially reclined TV position in which the seat and backrest are spaced a distance away from the room wall which is intermediate said predetermined distance and said greater distance, and wherein said front and said rear primary seat carrier links pivot in opposite circumferential directions during movement of the body-supporting means from said upright to said TV position.

14. The improvement as defined in claim 13, and wherein said rear primary seat carrier link moves relative to said base during movement of said body-supporting means from its TV position to its fully reclined position; and further comprising biasing means having its opposite ends operatively connected to the rear primary seat carrier link and the base, for exerting a return force on said rear primary seat carrier link during movement of the latter from its TV position to its fully reclined position.

15. The improvement as defined in claim 13, wherein each front primary seat carrier link moves relative to its respective seat-mounting link, while its associated front secondary seat carrier link remains fixed relative to the respective seat-mounting member, all during movement of the body-supporting means from said upright to said TV position; and wherein each front secondary seat carrier link moves relative to its respective seat-mounting link, while its associated front primary seat carrier link remains fixed relative to the respective seat-mounting member, all during movement of the body-supporting means from said TV to said fully reclined position.

16. The improvement as defined in claim 11 wherein said drive linkage means includes front arm carrier means at each side of the chair operatively supportively connecting a front arm portion of each arm-mounting member to the body support-to-base linkage means, and rear arm carrier means at each side of the chair operatively supportively connecting a rear arm portion of each arm-mounting member to the body support-to-base linkage means.

17. The improvement as defined in claim 16, wherein each front arm carrier means constitutes an elongated front arm carrier link having one end mounted to said front arm portion and its opposite end mounted to said front primary seat carrier link.

18. The improvement as defined in claim 16, wherein each rear arm carrier means includes an elongated rear arm carrier link having one end mounted to said rear arm portion and its opposite end operatively connected to said rear secondary seat carrier link.

19. The improvement as defined in claim 11, wherein said base includes an elongated base link at each side of the chair each base link having a front base portion, a rear base portion and a longitudinally-extending elevated base portion which extends from the rear base portion towards the front base portion over a substantial part of the length of the base link, said elevated base portion being spaced at a predetermined distance above the floor and defining a longitudinally-extending clearance channel therewith underneath the chair.

20. The improvement as defined in claim 19, wherein said one end of said rear primary seat carrier link is pivotally connected to said elevated base portion at a rear region thereof, and wherein said one end of said front primary seat carrier link is pivotally connected to the base link at said front base portion thereof, and wherein the longitudinal distance between the pivot connections of said front and rear primary seat carrier links on the base constitutes a major part of the length of the base link, to thereby provide good seat stability in the fore-aft direction due to the relatively wide spread between the front and rear seat carrier links.

21. The improvement as defined in claim 20, wherein the pivot connection of said rear primary seat carrier link is higher in elevation than the pivot connection of said front primary seat carrier link, to thereby improve the stability of the seat.

22. The improvement as defined in claim 19; and further comprising a lower rear arm crossrail interconnecting the armrests at a lower rear region of the armrest assembly, said lower rear arm crossrail being mounted on the armrest assembly for moving together with the latter during said reciprocating movement, said lower rear arm crossrail being received in said clearance channel and being movable therealong without mechanical interference with any of said linkage means.

23. The improvement as defined in claim 22, wherein said one end of said rear primary seat carrier link is pivotally connected to said elevated base portion, and wherein said rear primary seat carrier link extends downwardly from said elevated base portion for a short distance into said clearance channel but terminating short of the lower rear arm crossrail received in said channel, said short rear seat primary seat carrier link constituting a vertically compact linkage, to thereby provide the chair with a relatively low seat.

24. Hardware for a wall-proximity reclining chair of the type having (A) a base for supporting the chair on a floor;

(B) body-supporting means including a seat located generally above the base, and a backrest located generally rearwardly of the seat; and (C) a movable armrest assembly mounted for longitudinal horizontal reciprocating movement relative to the base, including a pair of armrests, each located at an opposite side of the seat;

said hardware including (1) a seat-mounting member mounted on the seat;

(2) a backrest-mounting member mounted on the backrest; and (3) an armrest-mounting member mounted on each armrest for moving the armrest assembly forwardly and rearwardly as a unit relative to the base in response to manual urging on the armrest assembly by a seated user;

the improvement comprising:

(a) body support-to-base linkage means kinematically connecting the seat-mounting member and backrest-mounting member directly to the base along a direct force-transmitting path which bypasses the armrest-mounting member such that any load having a force component which acts generally downwardly on the body supporting means is directly transmitted along the force-transmitting path only to the base, and not to the armrest-mounting member; and (b) drive linkage means for moving the body supporting means between an end-limiting upright position in which the seat-mounting member and backrest-mounting member are spaced a predetermined distance away from a room wall behind the chair, and an end-limiting fully reclined position in which the seat-mounting member and backrest-mounting member are forwardly spaced at a greater distance from the room wall such that physical contact of the body-supporting means with the room wall is voided in said positions, said drive linkage means operatively connecting the armrest-mounting member to said body support-to-base linkage means at by-pass connection points which transmit no downwardly-acting force component from the seat-mounting member and backrest-mounting member to the armrest-mounting member such that the latter is isolated from any transmission of downwardly-acting forces from the body supporting means in said positions of the latter, whereby the seat and backrest are moved between said positions without excessive wobble or instability.

* * * * *